US010357072B2

(12) United States Patent
Chong

(10) Patent No.: US 10,357,072 B2
(45) Date of Patent: Jul. 23, 2019

(54) WEARABLE ACCESSORY

(71) Applicant: Shong Voon Bonnie Chong, Singapore (SG)

(72) Inventor: Shong Voon Bonnie Chong, Singapore (SG)

(73) Assignee: Shong Voon Bonnie Chong, Singapore (SG)

( * ) Notice: Subject to any disclaimer, the term of this patent is extended or adjusted under 35 U.S.C. 154(b) by 290 days.

(21) Appl. No.: 15/212,303

(22) Filed: Jul. 18, 2016

(65) Prior Publication Data

US 2017/0000206 A1 Jan. 5, 2017

Related U.S. Application Data

(63) Continuation of application No. PCT/SG2016/050308, filed on Jun. 30, 2016, which is a continuation of application No. PCT/SG2015/050187, filed on Jun. 30, 2015.

(51) Int. Cl.

| | |
|---|---|
| ***A42B 1/20*** | (2006.01) |
| ***A42B 3/32*** | (2006.01) |
| ***A42B 1/00*** | (2006.01) |

(52) U.S. Cl.

CPC ..... *A42B 1/205* (2013.01); *A42B 1/004* (2013.01); *A42B 3/32* (2013.01); *A42B 3/324* (2013.01)

(58) Field of Classification Search

CPC ..... A42B 1/205; A42B 1/20; A42B 1/201; A42B 1/203; A42B 1/206; A42B 1/004; A42B 3/32

USPC ..... 2/420, 244, 171.03, 175.4, 195.5

See application file for complete search history.

(56) References Cited

U.S. PATENT DOCUMENTS

| | | | | | |
|---|---|---|---|---|---|
| 1,092,794 | A * | 4/1914 | Hughes et al. | A42B 1/045 | 135/906 |
| 1,665,750 | A * | 4/1928 | Mckee | A42B 1/062 | 2/12 |
| 2,428,937 | A * | 10/1947 | Lazarus | A42B 1/201 | 2/171.7 |
| 2,659,481 | A * | 11/1953 | Jones | A42B 1/18 | 2/46 |
| 3,049,720 | A * | 8/1962 | Caine | A42B 1/201 | 2/171.03 |
| 3,190,300 | A * | 6/1965 | Wear | E04H 15/003 | 135/126 |
| 3,514,787 | A | 6/1970 | Kennedy, Jr. | | |

(Continued)

FOREIGN PATENT DOCUMENTS

| | | | | |
|---|---|---|---|---|
| DE | 1053195 B | 3/1959 | | |
| WO | WO 0239838 A1 * | 5/2002 | ..... | A42B 1/201 |

(Continued)

*Primary Examiner* — Alissa L Hoey

(74) *Attorney, Agent, or Firm* — Horizon IP PTE Ltd.

(57) ABSTRACT

A wearable accessory 100 is disclosed herein. In a described embodiment, the wearable accessory 100 is configured in the form of a head protector 102 having at least one connector 150,180 and a plurality of accessory members 104 having respective attachment mechanisms 122. Each attachment mechanism 122 is releasably engageable to the at least one connector 150,180. The wearable accessory 100 may be configured as other types of accessories and a connector for use with the wearable accessory 100 is also disclosed.

18 Claims, 7 Drawing Sheets

(56) References Cited

U.S. PATENT DOCUMENTS 3,701,166 A * 10/1972 Lindblom ..... A41D 27/08 2/244
3,708,803 A * 1/1973 Teaff ..... A42B 1/201 2/171.01
3,991,422 A 11/1976 Saotome
4,291,417 A * 9/1981 Pagano ..... A42B 1/201 2/202
4,556,993 A * 12/1985 Okamura, Sr. ..... A42B 1/201 2/12
4,607,397 A * 8/1986 Laxo ..... A42B 3/322 2/410
4,611,368 A 9/1986 Battersby
4,741,053 A * 5/1988 Okamura, Sr. ..... A42B 1/22 2/12
5,116,288 A * 5/1992 Kondo ..... A45B 23/00 135/135
5,628,071 A * 5/1997 Nezer ..... A42B 3/322 2/410
5,896,590 A * 4/1999 Fleisch ..... A42B 3/322 2/410
D425,166 S * 5/2000 Mattson ..... D21/837
6,656,013 B1 * 12/2003 Wang ..... A41F 15/002 2/244
7,819,721 B1 * 10/2010 Messier ..... A41D 27/08 2/244
9,409,583 B1 * 8/2016 Bors ..... B62B 1/12
2002/0066290 A1 6/2002 Chen
2005/0155138 A1 * 7/2005 Zic-Hock ..... A41D 15/00 2/244
2012/0103014 A1 5/2012 Monroe
2013/0091620 A1 * 4/2013 Randolph ..... A41D 27/08 2/244
2015/0096109 A1 * 4/2015 Nackowski ..... A43B 23/24 2/245

FOREIGN PATENT DOCUMENTS

WO 2007116427 A1 10/2007
WO WO 2012060584 A2 * 5/2012 ..... A42B 1/062

* cited by examiner 204
302a 204
302b

302c

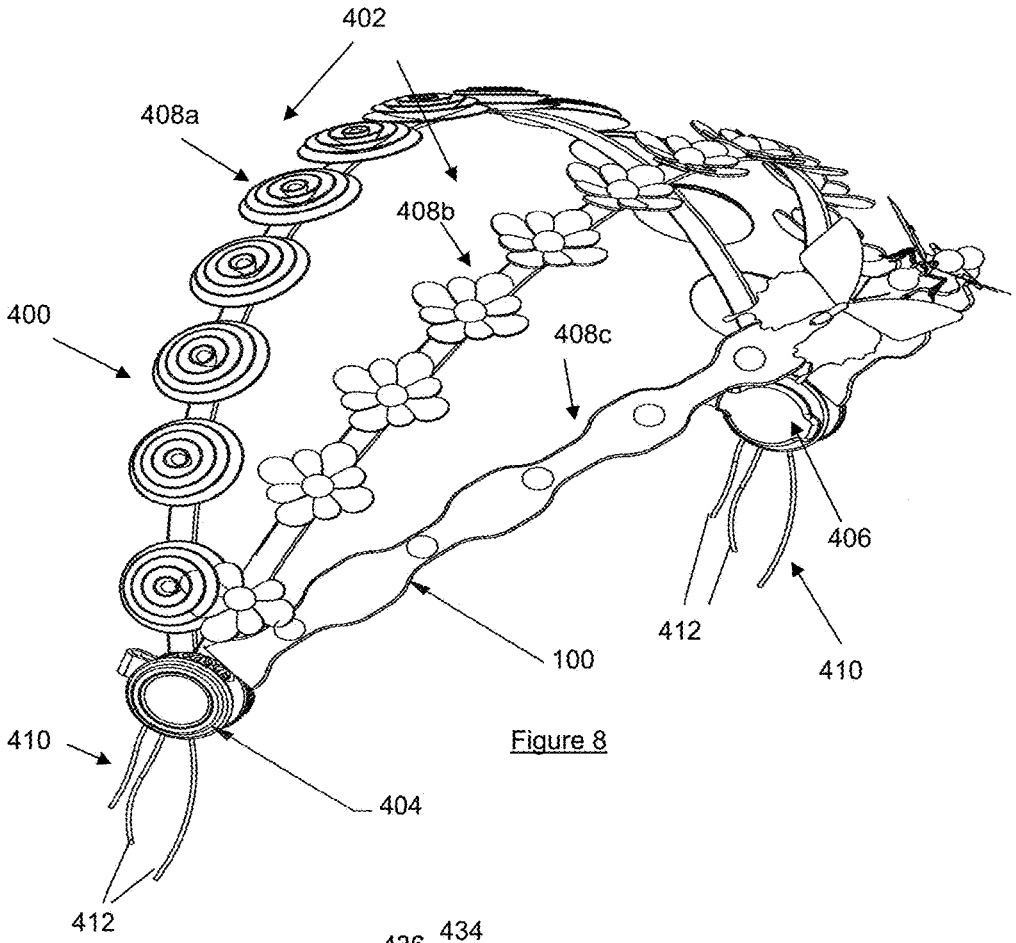
Figure 8
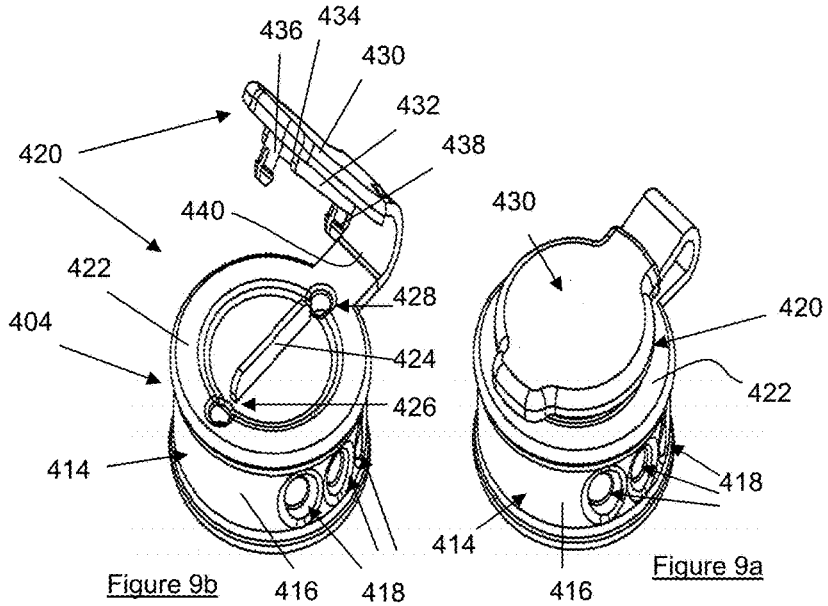
Figure 9b
Figure 9a

WEARABLE ACCESSORY

CROSS-REFERENCE TO RELATED APPLICATIONS

This application is a continuation of co-pending International Application No. PCT/SG2016/050308, filed on Jun. 30, 2016, which is a continuation of co-pending International Application No. PCT/SG2015/050187, filed on Jun. 30, 2015. All disclosures are herein incorporated by reference in their entireties for all purposes.

BACKGROUND AND FIELD

The invention relates to a wearable accessory.

Accessories have been used to enhance or decorate a person's appearance/clothing and quite often, the taste of the person determines type of accessories to wear. However, it is known that a person's taste may change with time, fashion trend and age etc and this may result in consumers wearing accessories for a short period of time and always buying new ones and more often than not, the old accessories are thrown away. This leads to wastage.

Thus, it is desirable to provide a wearable accessory which addresses at least one of the disadvantages of the prior art and/or to provide the public with a useful choice.

SUMMARY

In some aspects, there is provided a wearable accessory comprising at least one connector; and a plurality of accessory members having respective attachment mechanisms, each attachment mechanism (or attacher) being releasably engageable to the at least one connector.

In one aspect, a wearable accessory in the form of a head protector is described. In one embodiment, the head protector includes first and second connectors and a plurality of semi-rigid protective members adapted to match a shape of a user's head. Each of the protective members include respective attachers being arranged to be releasably connectable to the first and second connectors. The protective members are spaced away from each other to create gaps between each of the protective members.

In another embodiment, a head protector is described. The head protector includes a plurality of protective members. Each protective member includes a main semi-rigid elongated portion having first and second ends. An attacher having first and second loops are disposed at first and second ends of the elongated portion. The head protector further includes first and second connectors. The first loop of each attacher of the plurality of protective members is releasably coupled to the first connector. The second loop of each attacher of the plurality of protective members is coupled to the second connector. The protective members are adapted to conform to a shape of a user's head and are positioned in a spaced relationship with each other to create gaps between each of the protective members when the head protector is worn.

It should be appreciated that features relevant to one aspect may also be relevant to the other aspects described herein.

BRIEF DESCRIPTION OF THE DRAWINGS

Exemplary embodiments will now be described with reference to the accompanying drawings, in which:

FIG. 8 is a perspective view of a fifth embodiment of the wearable accessory 100 configured in the form of a hair band;

FIGS. 9*a* and 9*b* are closed up views of the accessory connector used in the hair band of FIG. 8;

DETAILED DESCRIPTION OF PREFERRED EMBODIMENTS

Figure 1A:
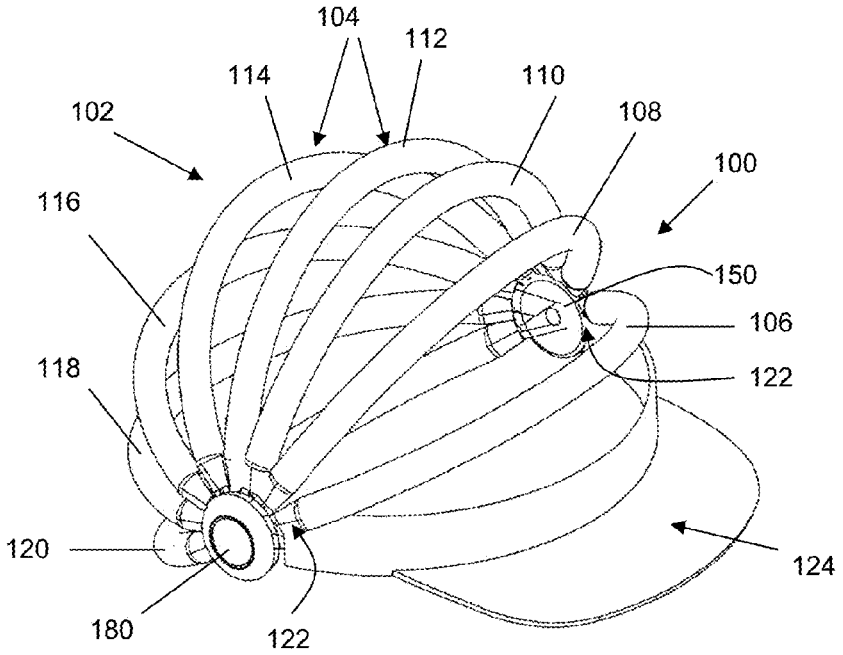
FIG. 1*a* is a perspective view of a wearable accessory in the form of a head protector having two connectors according to a first embodiment.

FIG. 1*a* is a perspective view of a wearable accessory 100 in the form of a head protector 102 having two connectors 150,180 according to a first embodiment. The head protector 100 includes a plurality of accessory members 104 and in this embodiment, the accessory members 104 include eight protective members 106,108,110,112,114,116,118,120 adapted to match a shape of a user's head and the eight protective members 106,108,110,112,114,116,118,120 have attachment mechanisms 122 arranged to releasably engage to the two connectors 150,180. The head protector 100 also includes a further accessory member in the form of a sun visor 124 which also includes the attachment mechanism 122. The sun visor 124 is arranged adjacent or before the first one of the eight protective members 106. In this embodiment, the sun visor 124 is made of ethylene-vinyl acetate (EVA) foam and cloth. Forming the sun visor using other materials may also be useful. The cloth may be fitted over the foam to provide different colors, patterns or designs.

In one embodiment, each protective member 106,108,110,112,114,116,118,120 may include a support rod (not shown) fitted with a cover to cushion the user's head against a fall. The cover may include a relatively soft cushion-like pliable material such as sponge, foam rubber or silicone or other materials such as elastomeric material to absorb impact. Other types of impact absorbing pliable materials may also be useful.

In an alternative embodiment, each protective member 106,108,110,112,114,116,118,120 may be devoid of a support rod. In such case, each protective member may be formed of a firm yet pliable material. For example, each protective member may include a material that is bendable and comfortable to wear. The protective member should be sufficient to absorb impact force to provide protection to the wearer. For example, the protective member should be sufficiently rigid to provide protection and return to a desired form after compression. In one embodiment, a resilient polymeric material may be employed to form a protective member devoid of a support rod. For example, the polymeric material may be solidified polymeric foam, such as polyethylene foam. Other suitable materials may also be useful.

Each protective member 106,108,110,112,114,116,118,120 should be at least partially rigid but yet flexible to conform to a shape of a user's head when the user wears the head protector 102. For example, as shown in FIG. 1*a*, each protective member adapted to be curved to match the general shape of the user's head. In one embodiment, the bendable protective members may be straight or relatively straight in a relaxed state and curved in a bent or flexed state to conform to a wearer's head. A fabric or cloth-like cover may be provided and fitted over each of the protective members. The cover may have same or different colors or designs for different protective members.

The attachment mechanism (or attachers) 122 of each protective member 106,108,110,112,114,116,118,120 and the sun visor 124 may be similar. Providing different types of attachers 122 for the protective members and sun visor may also be useful.

In one embodiment, the attacher 122 is in the form of a loop disposed at first and second ends of each accessory member 104. The loop may be an elastic loop, such as an elastic band (e.g. 126,130). For example, the loop may be attached to the cover of each of the protective members. For example, the loop may be sewed or stitched to the cover. Attaching or mounting the loops on the ends of the protective members by other techniques may also be useful.

The use of an elastic material for at least the attacher 122 advantageously enables the accessory members 104 to have a range of lengths. For example, a range of length may be from the elastic material's un-stretched state to its fully stretched state. This facilitates fitting of the head protector 102 onto the head of the wearer as well as flexibility in conforming to different head sizes within the length range of the elastic material. The protective members may be provided in different lengths to accommodate different head sizes.

In some embodiments, the loop may be part of the support rod (not shown) of each protective member. For example, the support rod and loops may be an integrated unit. Providing non-integrated support rod and attacher 122 may also be useful. In other embodiments, the integrated support rod (not shown) and attacher 122 may be a string formed in a loop. A cushioned cover may be fitted over the support rod, exposing the loops at the ends.

Figure 1B:
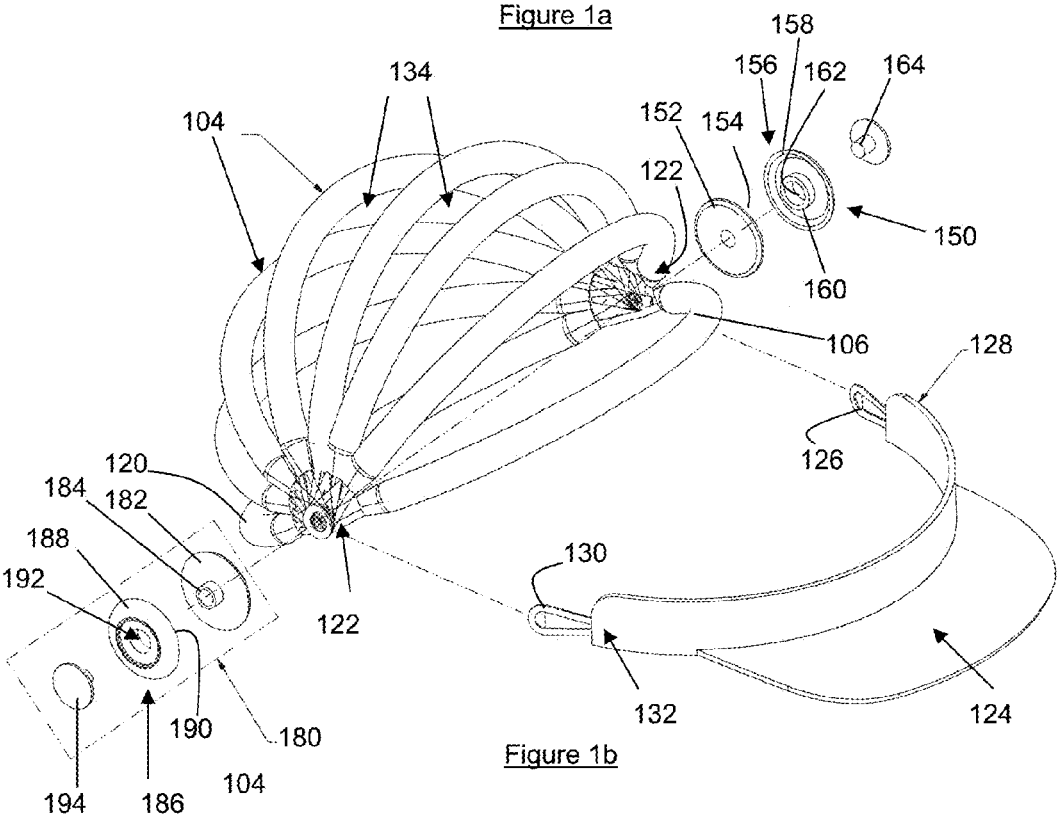
FIG. 1*b* is an exploded perspective view of the head protector of FIG. 1*a* which shows the connectors in greater detail.

FIG. 1*b* is an exploded perspective view of the head protector of FIG. 1*a* which shows the various parts in a spaced relationship. As shown, the head protector includes protective members 106,108,110,112,114,116,118,120 and the sun visor 124. The sun visor includes an attacher 122 with a first loop 126 at one end 128 and a second loop 130 at the other end 132. The loops, for example, may be elastic bands. Other types of loops may also be useful. In some embodiments, the loops 126,130 and sun visor 124 may be an integrated unit. Providing non-integrated sun visor and loops may also be useful. FIG. 1*b* also illustrates a structure of the first and second connectors 150,180 according to a first embodiment.

In the first embodiment, the first and second connectors 150,180 are made of silicone rubber which should be without any hazardous chemicals in view of the usage of the head protector 102 as will be explained below. Each connector 150,180 includes a disc shaped base member 152,182 having a coupling stud 154,184 which protrudes from the base member 152,182 for engagement with the attacher 122. Specifically, using the attacher 122 of the sun visor 124 as an example, the first and second elastic bands 126,130 are looped around the coupling stud 154,184. As shown in FIG. 1*b*, this allows each protective member 106,108,110,112,114,116,118,120 and the sun visor 124 to be releasably attached to the coupling stud 154,184 in a spaced relationship with each other to create spacing or gaps 134 between the protective members and the sun visor 124. In view of the flexibility and semi-rigidity of the protective members 106,108,110,112,114,116,118,120, the protective members may wrap around the user's head they are able to form the shape of a helmet to match the user's head.

Further, each connector 150,180 includes a locking member 156,186 having a disc-shaped locking base 158,188 and a cylindrical engagement member 160,190. Each locking base 158,188 includes a centre aperture 162,192 and the cylindrical engagement member 160,190 protrudes outwardly from the respective centre aperture 162,192 and is configured to frictionally fit with the corresponding coupling stud 154,184 of the base member 152,182 to secure the attacher 122 to the coupling stud 154,184. It should be appreciated that the locking members 156,186 are detachable from the respective base member 152,182 to allow the attacher 122 (i.e. the elastic bands 126,130) to be uncoupled from the coupling studs 154,184. In this way, the protective members 104 may be interchanged with a different type, size or other designs. Each connector 150,180 further includes a locking pin 164,194 which is insertable into the centre aperture 162,192 to keep the entire assembly of the connectors 150,180 together, to give an overall look of a "button".

Figure 2A:
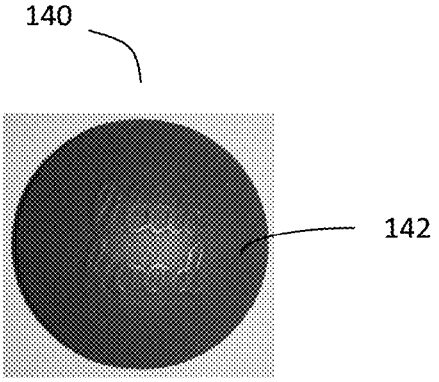
FIGS. 2*a*-2*d* are perspective views of the connectors of FIG. 1*a* according to a second embodiment.
Figure 2B:
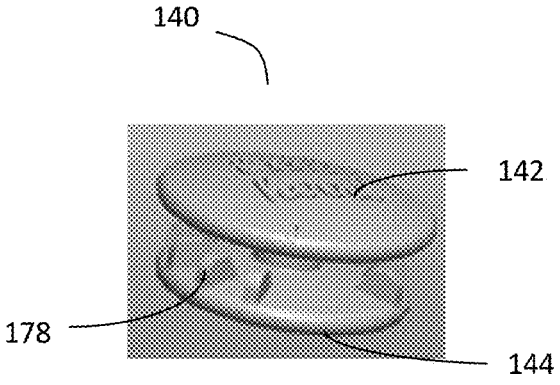
Figure 2C:
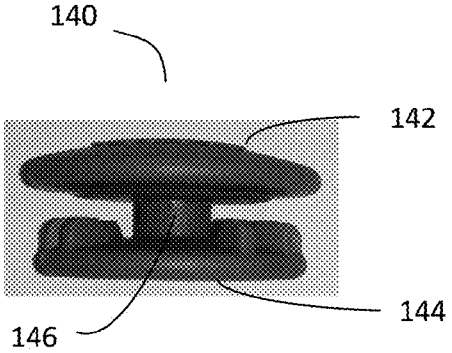
Figure 2D:
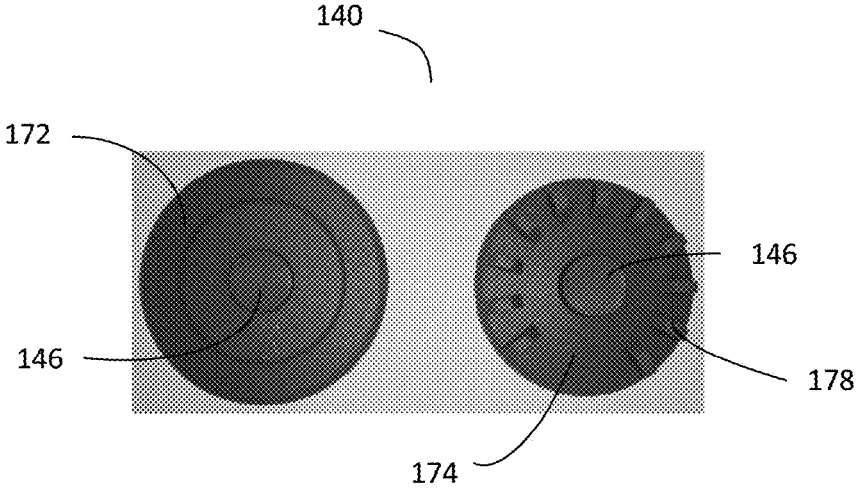

FIGS. 2*a*-2*d* are perspective views of an alternative structure of the connectors 150,180 illustrated in FIG. 1*a*. For example, the head protector 102 may include accessory members 104 having attachers 122 arranged to releasably engage to two (or a pair of) connectors 140 according to a second embodiment. FIG. 2*a* shows a top view of one of the connectors 140; FIGS. 2*b*-2*c* show various side views of one of the connectors 140; and FIG. 2*d* shows various cross-sectional views of one of the connectors 140.

In one embodiment, the connector 140 includes a single continuous structure. For example, the connectors 150,180 may include a complete structure devoid of detachable parts according to a second embodiment. The connector 140 is, for example, made of silicone rubber. Other suitable materials may also be useful. The connector 140 may include a head element 142 coupled to a circular base 144 by a coupling member 146. As shown, the head element 142 and base 144 have circular shapes, with the head element 142 having a larger diameter than the base 144. For example, the head element 142 includes a diameter of about 3.0-3.5 cm while the base 144 includes a diameter of about 2.5-3.0 cm. However, providing a head element 142 and a base 144 having the same diameter or other shapes may also be useful.

In one embodiment, the head element 142 may include a convex top surface and a bottom surface 172 that is in contact with the coupling member 146.

Providing the head element 142 with other shaped top surface may also be useful. The coupling member 146 includes a sufficient length to accommodate a predetermined number of attachers 122 corresponding to a predetermined number of accessory members 104, and a sufficient width to allow the attacher 122 to securely and easily loop around the coupling member 146.

In one embodiment, the circular base 144 includes multiple posts (or ribbings) 178 protruding from an inner surface 174. The ribbings 178 are, for example, evenly spaced apart and positioned around the circumference of the base 144. The head element 142, coupling member 146 and base 144 may be integrally formed to provide a single continuous structure as shown. This avoids the use of small detachable parts in the connectors 150,180 which may pose a choking hazard to young children.

Similar to the embodiment shown in FIGS. 1*a*-1*b*, the attachers 122 of the accessory members 104 (i.e., the protective members and sun visor 124) are looped around the coupling member 146 of each connector 140 to allow each accessory member 104 to be releasably attached to a pair of connectors 140. An attacher includes, for example, an elastic band. The head element 142 and circular base 144 traps the attacher 122 within the connector 140. A portion of the attacher 122 may further slot into the spaces between the ribbings 178. The ribbings 178 restrict the radial movement of each attacher 122 attached to the connector 140 to prevent the accessory members 104 from bunching. In this way, the spaced relationship between different accessory members 104 is maintained. In one embodiment, a segment of the circular base 144 which is positioned directly opposite from the accessory members 104 (e.g., facing downwardly) may be devoid of ribbings since no portion of the attacher 122 would extend over that portion when releasably engaged to the connector 140. Providing a complete circle of ribbings around the circumference of the base 144 may also be useful.

It should be appreciated that the connectors 150,180 as illustrated in FIGS. 1*a*-1*b* according to the first embodiment may also be provided with ribbings 178. For example, the disc shaped base member 152, 182 of the connectors 150, 180 may be adapted to include ribbings 178. Other configurations of a connector with ribbings may also be useful.

Once assembled, the head protector 102 is as illustrated in FIG. 1*a* and it should be appreciated that the protective members 104 (and the sun visor 124) are held in position by the connectors 150,180 to create a shape and look of a hat or cap to be worn by a user, such as an infant who is learning to walk. Inevitably, the infant may be susceptible to falling and thus, the head protector 102 is useful to cushion the infant from hurting his/her head. The spacing 134 created by the spaced apart protective members allows ventilation especially in humid climates to keep the infant's head ventilated. The sun visor 124 protects the toddler from the sun's rays. Needless to say, the head protector is very flexible in that the number and size of the protective members may be varied depending on the age of the child, and also the sun visor 124 may be omitted or attached as required.

Also, decorative accessory members 104 may be used in place of the ones illustrated in FIG. 1*a*, although only one or some may be replaced. Indeed, the head protector 102 (or generally the wearable accessory) has the flexibility to "grow" with the child. For example, when the toddler is already able to walk comfortably, the protective members may be replaced or interchanged with other designs, types and patterns according to the child's desire or taste. For example, one or more protective members may be interchanged with aesthetically pleasing accessory members that include decorations or decorative ornaments. It should also be appreciated that the connectors 150,180 as described in FIGS. 1*a*-1*b* and 2*a*-2*d* may be fitted with a decorative cover for aesthetic purposes. Indeed, the head protector 102 may also be a fashion accessory to the child as he/she grows up and the design and decorations may be changed according to the latest fashion trends. In view of the potential uses of the head protector 102, the material of the connectors 150,180 is also chosen to be child friendly and safe and thus, there should not be any hazardous chemicals since there is a chance of the infant or toddler putting the head protector 102 in his/her mouth. This similarly applies to the accessory members 104 (i.e., the protective members and sun visor 124).

With its flexibility, it should also be apparent that the head protector 102 may also be worn by infirm adults or patients susceptible to falling. Indeed, the size, type and design of the protective members 104 may be interchanged or varied according to the needs of the user.

It should be appreciated that each of the protective members (and the sun visor 124) has a generic attacher 122 and this makes it more convenient and easier for different protective members (or generally accessory members 104) to be used with the connectors 150,180 to make the wearable accessory 100 more useful and versatile. Also, the protective members (and the sun visor 124) share common pivoting points i.e. the two connectors 150,180 and this makes the head protector 102 more versatile to be adjusted. In some embodiments, decorative ornaments having one or more attachers similar to that of the accessory members 104 may be provided. For example, decorative ornaments may be configured with elastic loops to releasably attach to one or more protective members (or accessory members) and/or connectors 150,180. This advantageous allows the head protector 102 to be fitted with interchangeable decorations or decorative ornaments.

The versatility and usefulness of the wearable accessory 100 may be appreciated from further embodiments. Indeed, each of the pliable protective members 106,108,110,112, 114,116,118,120 may also be configured to include sufficient structural strength to accommodate secondary accessory components (not shown) for decorative and/or functional purposes. In one embodiment, the secondary accessory components may include one or more attachers 122 for direct coupling with a protective member. For example, secondary accessory components in the form of a decorative shape, such as flower shape, may be selectively mounted onto one or more protective members as desired. In other alternative embodiments, a secondary accessory component in the form of a sun visor similar to that described in FIGS. 1*a*-1*b* may be selectively mounted to one of the protective members (e.g., 106 or 120). In such case, the sun visor may be configured with more than two attachers 122 to securely fasten the sun visor in a user-desired position on a user-selected protective member. In yet another embodiment, a secondary accessory component in the form of sunglasses may be provided. For example, a secondary accessory component having tinted lenses may be selectively mounted to a protective member. Providing secondary accessory components in other decorative and/or functional forms may also be useful. Providing a secondary accessory component with other types of attachment mechanism (or attacher) may also be useful. For example, secondary accessory components may be configured with attachers in the form of a sleeve, or a releasable fastener, or a combination thereof.

Figure 3:
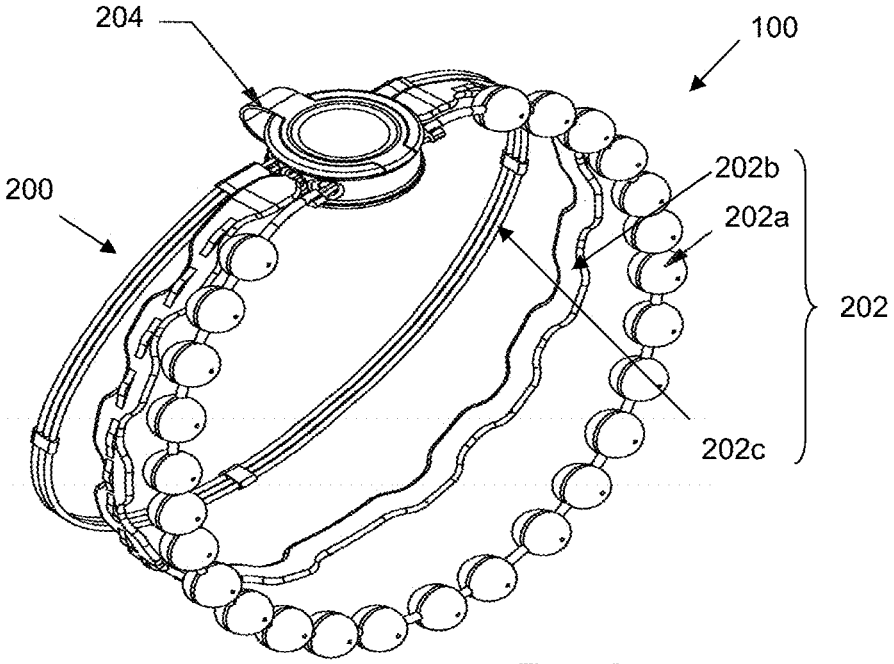
FIG. 3 is a perspective view of another wearable accessory in the form of a bracelet having a bracelet connector according to a third embodiment.

FIG. 3 illustrates a third embodiment of the wearable accessory 100 configured in the form of a bracelet 200. The bracelet 200 includes a number of accessory members 202 in the form of three different wrist strips 202*a*,202*b*,202*c* releasably engageable to an accessory connector 204 which is shown in a closed position in FIG. 3.

Figure 4:
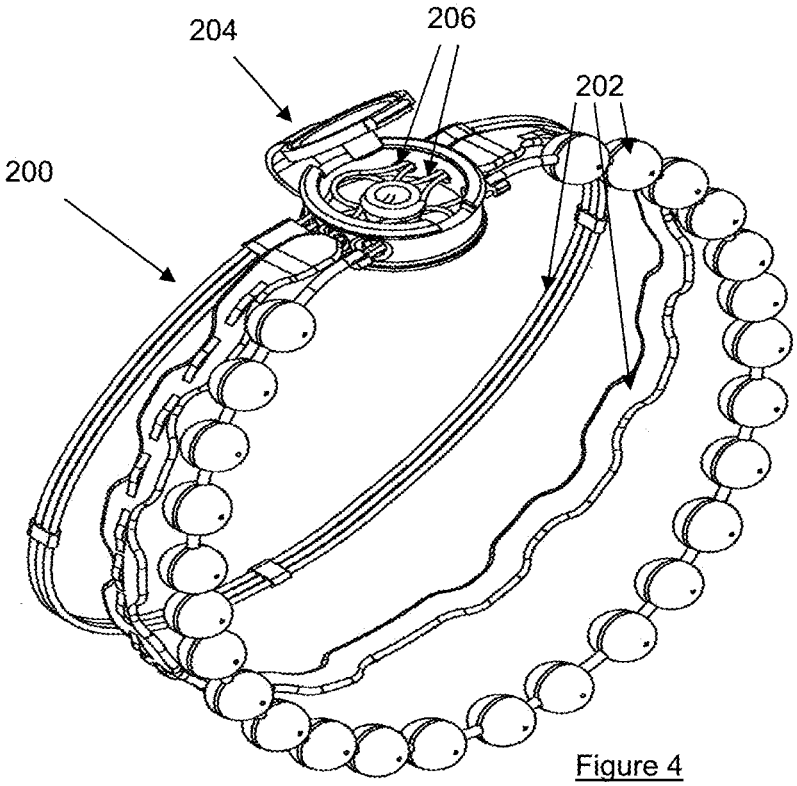
FIG. 4 shows the bracelet of FIG. 3 with the bracelet connector in an opened position.

FIG. 4 shows the bracelet 200 of FIG. 3 with the accessory connector 204 in an opened position and it should be appreciated that each wrist strip 202 includes a bracelet attachment mechanism 206 similar to the ones illustrated in the first embodiment of FIGS. 1*a* and 1*b* and thus, the bracelet attachment mechanism 206 would not be further elaborated.

Figure 5:
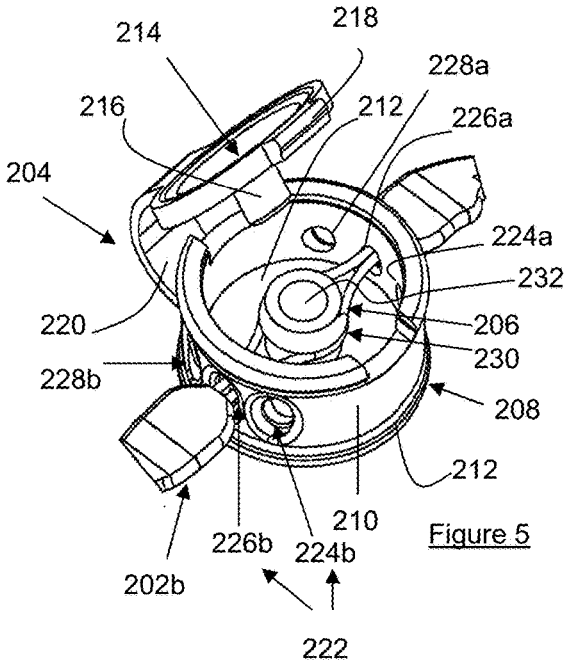
FIG. 5 is a closed up view of the bracelet connector of FIGS. 3 and 4.

FIG. 5 is a closed up view of the accessory connector 204 of FIGS. 3 and 4 and for ease of explanation, is arranged to be attached to a bracelet attachment mechanism 206 of the second wrist strip 202*b*. The accessory connector 204 includes a cylindrical shape casing 208 with a circumferential wall 210 and a casing base 212 attached to the circumferential wall 210 at one side and an opening 212 at the other side of the circumferential wall 210. The accessory connector 204 includes a resealable cap 214 arranged to cover the opening 212. The cap 214 includes a catch 216 at its periphery and the catch 216 is arranged to latch onto a corresponding lug (not shown) at the circumferential wall 210 to keep the cap 214 in a closed position (as shown in FIG. 3). The cap 214 also includes a rib 218 to allow the user to pry open the cap 214 which is the position shown in FIG. 5.

The accessory connector 204 includes a side flap 220 projecting from part of the circumferential wall 210 and attached to part of the cap 214 so that the cap 214 is attached to the circumferential wall 210 when the cap 214 is in the opened position to prevent the cap 214 from being lost.

As shown in FIG. 5, the circumferential wall 210 includes a number of through holes 222 and in this second embodiment, some of the through holes 222 are formed on one side of the circumferential wall 210 with some on the opposite side of the circumferential wall 210. In this way, the though holes 222 form three sets of facing and aligned holes with a first set of aligned holes 224*a*,224*b* meant for the first wrist strip 202*a*, a second set of aligned holes 226*a*,226*b* for the second wrist strip 202*b* and a third set of aligned holes 228*a*,228*b* for the third wrist strip 202*c*. The accessory connector 204 further includes a coupling element 230 with an oversize head element 232. Using the second wrist strip 202*b* as an example, ends of the bracelet attachment mechanism 206 are inserted through the respective second set of aligned holes 226*a*,226*b* and for the bracelet attachment mechanism 206 to loop around the coupling element 230 with the oversize head element 232 trapping the bracelet attachment mechanism 206 in place. In this way, the bracelet attachment mechanism 206 is engaged or connected to the coupling element 230 of the accessory connector 204. It should be appreciated that the first and third wrist strips 202*a*,202*c* are attached to the coupling member 230 in the same manner i.e. through respective first and second sets of aligned holes 224*a*,224*b*,228*a*,228*b* and similarly looped around the coupling member 230. The cap 214 may then be closed to create an aesthetically pleasing look and feel to the accessory connector 204. Similar to the first embodiment, the wrist strips 202 are coupled to a common coupling member 230 which allows the wrist strips 202 to be spread out radially.

It should be appreciated that the accessory connector 204 of the third embodiment may be replaced by the connector 150,180 of the first embodiment, although this may not be preferred. Similarly, the connector 150,180 of the first embodiment may be replaced with the accessory connector 204 of the third embodiment since the accessory connector 204 of the third embodiment is integrally formed.

Figure 6:
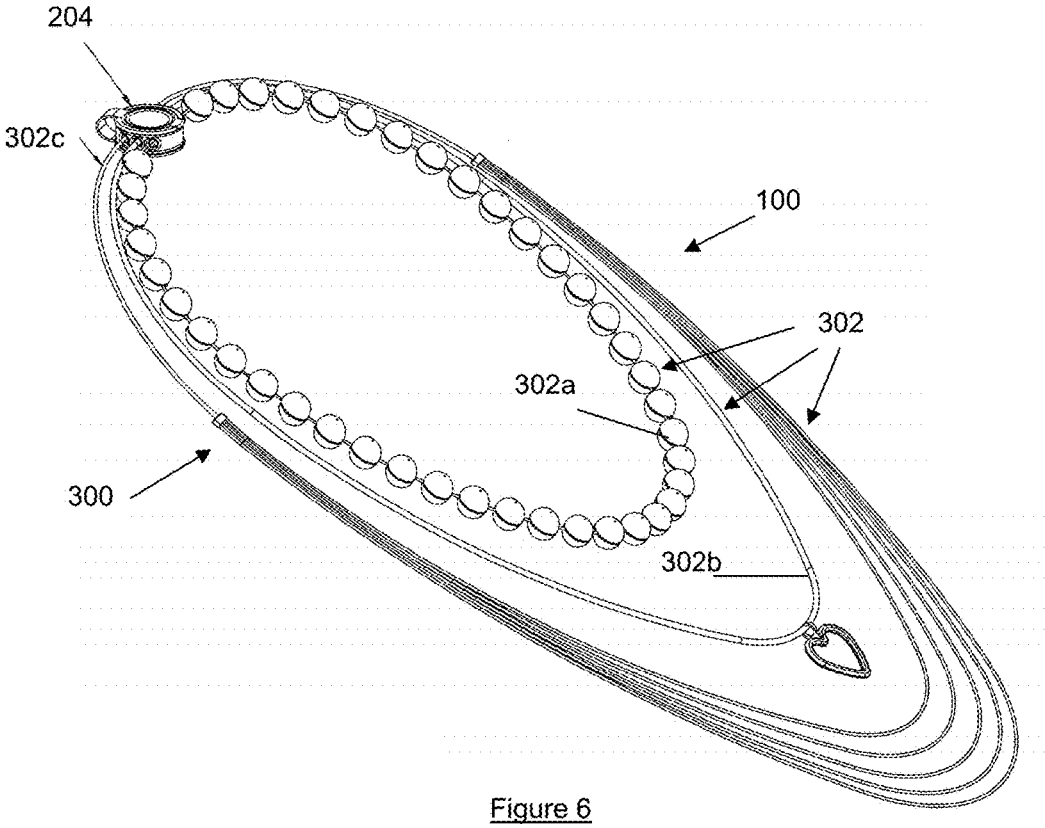
FIG. 6 is a perspective view of a fourth embodiment of the wearable accessory 100 configured in the form of a necklace 300.
Figures 7A, 7B, 7C:
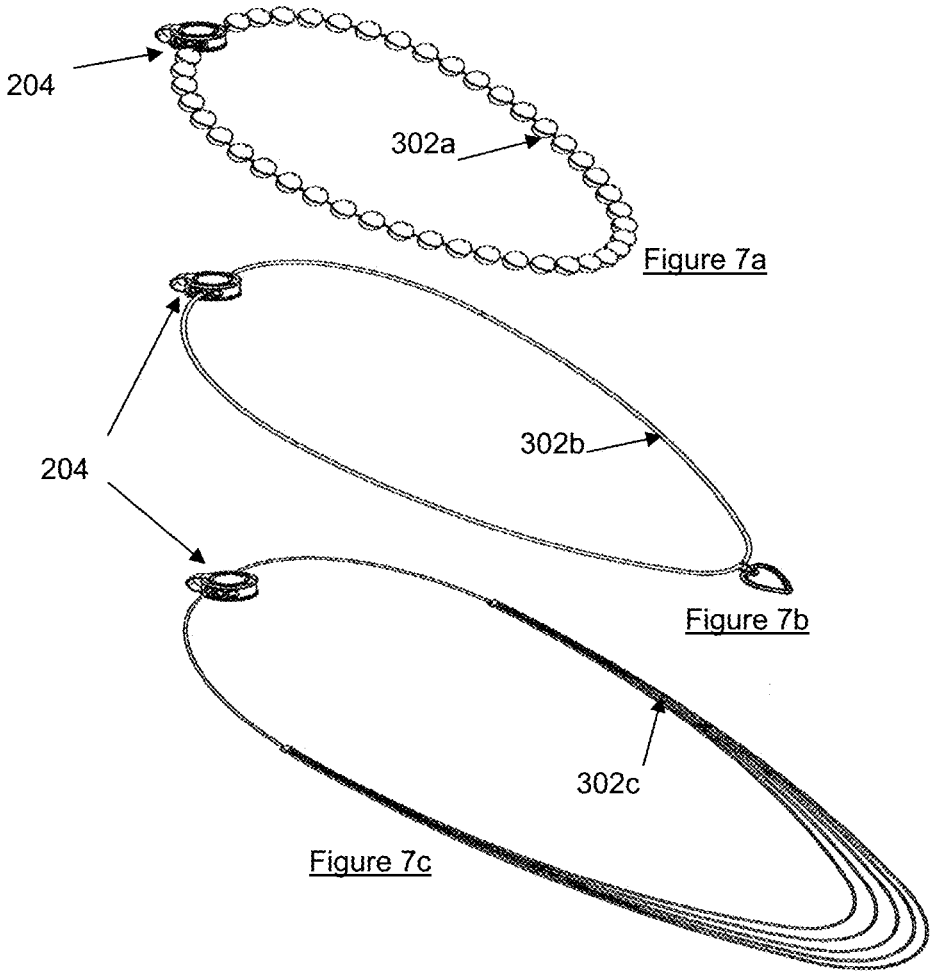
FIGS. 7*a* to 7*c* illustrate different variations of the wearable accessory 100 of FIG. 6.

FIG. 6 illustrates a fourth embodiment of the wearable accessory 100 configured in the form of a necklace 300 using the accessory connector 204 of the third embodiment. As it can be appreciated, the necklace 300 comprises a number of accessory members 302 and in this embodiment, the accessory members 302 includes three necklace pieces 302*a*,302*b*,302*c* having attachment mechanisms (or attachers) similar to that used in the first and third embodiments and this allows the necklace pieces 302*a*,302*b*,302*c* to be releasably engaged or connected to the accessory connector 204. Since the necklace pieces 302*a*,302*b*,302*c* are interchangeable and removable, different designs may be created. For example, FIGS. 7*a* to 7*c* illustrate using the accessory connector 204 to create different necklace designs and in particular, FIG. 7*a* illustrate the accessory connector 204 attached to only the first necklace piece 302*a*, FIG. 7*b* illustrate the accessory connector 204 attached only to the second necklace piece 302*b* and FIG. 7*c* illustrate the accessory connector 204 attached only to the third necklace piece 302*c*.

FIG. 8 is a perspective view of a fifth embodiment of the wearable accessory 100 configured in the form of a hair band 400. The hair band 400 includes a number of accessory members 402 which is releasably engageable to two fifth embodiment accessory connectors 404,406. The accessory members 402 include three hair band units 408*a*,408*b*,408*c* with ends having attachment mechanism 410 in the form of strings 412 having respective free ends instead of loops.

The strings 412 are arranged to be engaged with respective fifth embodiment accessory connectors 404,406 and FIG. 9*a* illustrate one of the fifth embodiment accessory connector 404 in a closed position and FIG. 9*b* illustrate the fifth embodiment accessory connector 404 in an opened position. The fifth embodiment accessory connector 404 is similar in structure to the accessory connector 204 of the third embodiment and also includes a fifth embodiment casing 414 having a casing circumferential wall 416 and also three sets of aligned holes 418 (the holes on the opposite sides are not shown in FIGS. 9*a* and 9*b*) similar to the ones of the third embodiment. Unlike the fourth embodiment accessory connector 204, the fifth embodiment connector 404 also includes a hair clip 420 attached to a base surface 422 of the fifth embodiment casing 414. The hair clip 420 includes a first elongate clip member 424 (see FIG. 9*b*) formed on the base surface 422 with two engagement apertures 426,428 formed on the base surface 422 and at either end of the first elongate clip member 424. The hair clip 420 further includes a resealable closure member 430 having a second elongate clip member 432 and a third elongate clip member 434 disposed on an inner surface of the resealable closure member 430. The positions of the second elongate clip member 432 and the third elongate clip member 434 are spaced apart so that when the closure member 430 is closed, the first elongate clip member 424 is interposed between the second elongate clip member 432 and the third elongate clip member 434 and the cooperation between the first, second and third elongate clip members 424,432,434 allows the hair clip 420 to clip onto the user's hair. Specifically, in this embodiment, the closure member 430 also includes first and second closure member catches 436,438 arranged to be inserted and latched to the corresponding engagement apertures 426,428 to hold the hair clip 420 in the closed position as shown in FIG. 9*a*. It should be apparent that in this position, the first elongate clip member 424, the second elongate clip member 432 and the third elongate clip member 434 cooperate to clip onto the user's hair and in this way, the fifth embodiment accessory connector 404 also doubles up as a hair clip for the user.

The fifth embodiment connector 404 also includes an adjoining flap 440 to connect the closure member 422 to the fifth embodiment casing 414.

To use the connector 404, the length of the hair band units 408*a*,408*b*,408*c* may be adjusted to the user's liking and each string 412 is inserted through a respective set of the aligned holes 418 (i.e. each string 412 is inserted through two holes with its free end coming out through the other hole as shown in FIG. 8) and the free ends of the strings 412 are then brought together to form a knot (which forms a common connection point). Consequently, the knot (not shown) formed by the hair band units 408*a*,408*b*,408*c* are arranged to engage with an external part of the casing 414 of the connector 404 (and also the other connector 406). The user may then use the hair clip 420 to clip the connectors 404,406 to the user's hair in a manner which the user prefers. To release the hair band units 408*a*,408*b*,408*c* from the engagement with the connectors 404,406, the knot is simply undone which allows the hair band units 408*a*,408*b*,408*c* to be interchanged or replaced with other designs or types. This embodiment also has the flexibility of allowing the user to adjust the length of the hair band 400 by clipping the hair band 400 onto the hair at whichever part of the user's head that is comfortable to the user.

Figure 10:
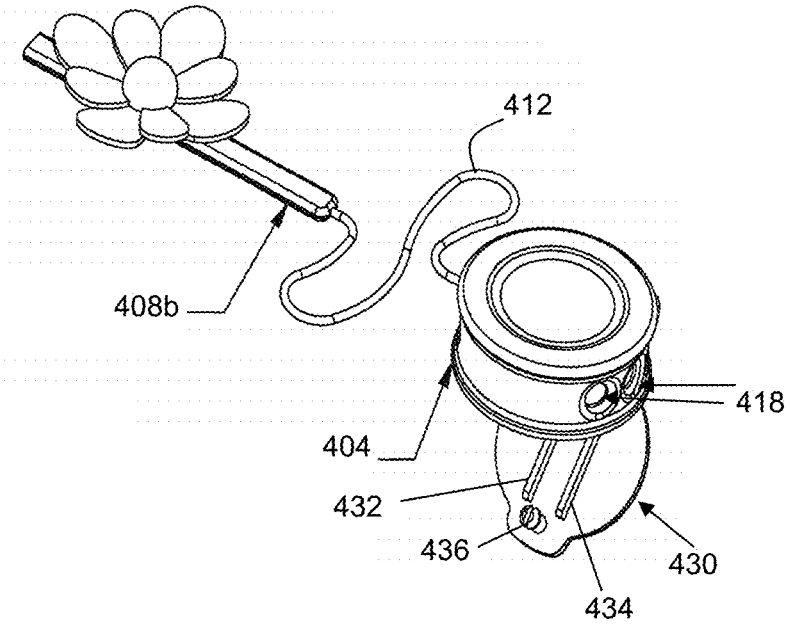
FIG. 10 illustrates part of the hair band unit of the hair band of FIG. 8 and the accessory connector of FIGS. 9*a* and 9*b*.

FIG. 10 is a closed up view of a portion of FIG. 8 to show the attachment mechanism 410 of the second hair band unit 408*b* more clearly and one of the accessory connectors 404.

As it can be appreciated from the various embodiments, the accessory members are interchangeable to create different wearable accessories. The wearable accessories may be in the form of a cap, hat, bracelet, necklace, hair hands etc. and the interchangeability provides the user with the flexibility and versatility to create his/her own design, desire and comfort of use. Indeed, the accessory members may come in different shapes, sizes and lengths to accommodate to all ages and thus, the wearable accessory 100 may be considered to grow with the user. This may be useful to reduce wastage of accessories and contribute to the green initiative of conserving the earth's resources. Indeed, with the connectors 150,180,204,404,406, the user may interchange the accessory members (such as the protective member 106, 108,110,112,114,116,118,120, the necklace pieces 302*a*, 302*b*,302*c* and the hair band units 408*a*,408*b*,408*c*) according to his/her wishes, desire and/or creativity to make the wearable accessory 100 more environmentally friendly.

The described embodiments should not be construed as limitative. For example, other types of connectors may be used, not just those described 150,180,204,404,406 and illustrated in the figures. Indeed, the connectors may incorporate a battery to power light sources to give or emit light of different colours. Also, in terms of safety, a tracking device may be incorporated within the connector casing which may be useful to track the position or location of the wearer (especially when used by infants, patients or the elderly). Similarly, the attachment mechanism 122,206,410 may also be changed or modified based on the type of connector being used. For example, instead of the elastic bands 126,130 or strings 412, the attachment mechanism (or attacher) may include a silicone tube and the connectors 150,180 may be modified accordingly. For example, the locking member 156,186 may be modified to have corresponding holes to allow respective silicone tubes to be inserted and the locking pins 164,194 modified to have similar number of holes to engage a part of the silicone tubes frictionally to the extent of squeezing the silicone tubes flat to engage them securely.

Figure 11:
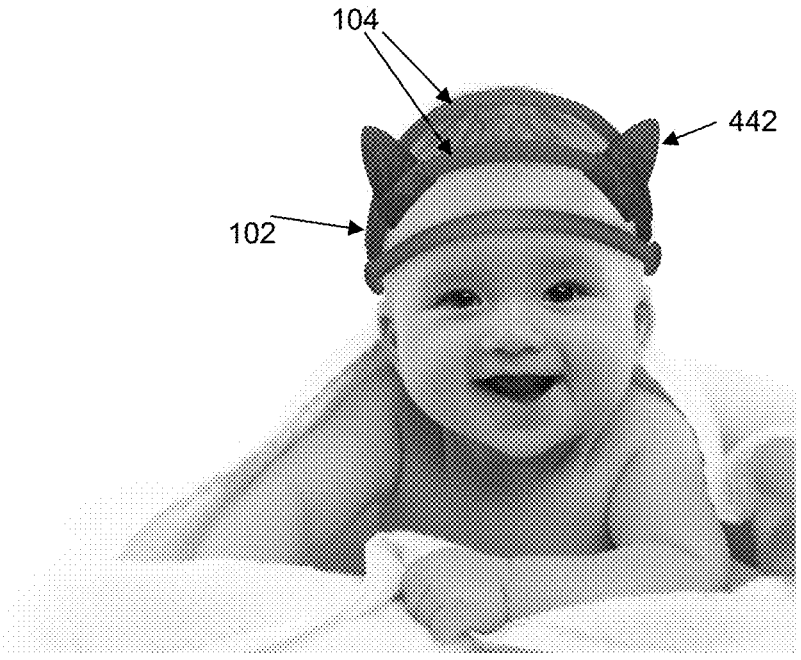
FIG. 11 illustrates the head protector of FIG. 1*a* being worn on a baby or toddler and fitted with additional decorations.

Similarly, the accessory members 104,202,302 and the connectors 150, 180,204,404,406 may come in or fitted with other designs and decorations. As an example, FIG. 11 shows the head protector 102 of FIG. 1*a* being worn by a baby or toddler and one of the accessory members 104 fitted with additional decorations 422. Also, the accessory members 104,202,302 may have additional functions, not just for decorative purposes. For example, it is often for participants to an event to be identified by colour codes to represent different access rights to selected events and thus, the accessory members 104,202,302 may be colour coded to provide such functions. In view of the interchangeability, the accessory members 104,202,302 may be replaced accordingly, and thus, reused or recycled. Further, the protective members 106,108,110,112,114,116, 118,120 of the first embodiment may provide other functions. For example, the protective members 106,108,110,112,114,116, 118,120 may be configured with material to relieve the user of certain discomfort. Taking fever as an example, at least some of the protective members may be attached with material to help reduce the temperature on the forehead of the user. Also, it is envisaged that at least part of the accessory member 104 may be made of fiberglass.

Indeed, the hair band units 408*a*,408*b*,408*c* of the fifth embodiment may not be rigid but rather they may be formed from flexible materials such as cloth which allows the hair band units 408*a*,408*b*,408*c* to conform naturally to the shape of the head and support for the hair band units 408*a*,408*b*, 408*c* may then be provided by the connectors 404,406 when they are attached or clipped to the user's hair.

The connectors 150,180,204,404,406 may also be configured to incorporate fanciful designs and decorations to make them more aesthetically pleasing. For example, the cap 214 of the connector 204 of FIG. 5 may incorporate a gemstone or diamond(s) to target consumers who may prefer more elaborate designs. The connectors 150,180,204 as described may be equipped with a similar hair clip 420 of the hair band 400 of the fifth embodiment.

Also, it is possible that the connectors 150,180,204,404, 406 and the accessory members 104,202,302 are provided in unassembled form, for example, as a kit, where the user assembles the kit himself/herself. Thus, the accessory members 104,202,302 may be releasably connectable to at least one of the connectors 150,180,204,404,406.

Having now fully described the invention, it should be apparent to one of ordinary skill in the art that many modifications can be made hereto without departing from the scope as claimed.

The invention claimed is:

1. A head protector wearable by infants and small children, comprising:

first and second connectors;

the first connector comprises a first connector post having a first end and a second end, the first end of the first connector post connected to a first connector base and the second end of the first connector post connected to a first connector head, wherein the first connector base and the first connector head are larger than the first connector post, and the second connector comprises a second connector post having a first end and a second end, the first end of the second connector post connected to a second connector base and a second end of the second connector post connected to a second connector head, wherein the second connector base and second connector head are larger than the second connector post;

a plurality of elongated bendable protective members having first and second ends comprising a protective material that is flexible, resilient and shock absorbent, wherein the protective members are straight or relatively straight protective members when in a relaxed state and are curved when in a bent or flexed state, wherein the protective members are configured to provide protection to a wearer's head when the head protector is worn;

wherein the protective members are distinct members that are spaced away from each other to create gaps between each of the protective members when the head protector is worn;

a first attacher attached to the first end of each protective member, wherein the first attacher comprises a first flexible loop;

a second attacher attached to the second end of each protective member, wherein the second attacher comprises a second flexible loop;

wherein the first and second attachers releasably engage the first and second connectors; and wherein when assembled to form the head protector, the protective members remain distinct members in which the first attacher of each of the protective members are commonly looped around the first connector post between the first connector head and first connector base, and the second attacher of each of the protective members are commonly looped around the second connector post between the second connector head and second connector base.

2. The head protector of claim 1 wherein the first and second connectors comprise ribbings protruding from an inner surface of the first and second connectors for restricting radial movements of the first and second attachers of the protective members when assembled to form the head protector.

3. The head protector of claim 1 wherein the first and second connectors each comprises a single structure formed of a rubber material.

4. The head protector of claim 3 wherein the first and second connectors comprise ribbings protruding from an inner surface of the first and second connectors for restricting radial movements of the attachers of the protective members when assembled to for the head protector.

5. The head protector of claim 4 comprises a sun visor accessory member, wherein the sun visor accessory member comprises first and second visor attachers at first and second ends of the sun visor assessor member, the first and second visor attachers comprise first and second visor flexible loops for looping around the first and second connector posts of the first and second connectors.

6. The head protector of claim 1 wherein the protective material of the protective members comprises solidified polymeric foam or an elastomeric material.

7. The head protector of claim 1 wherein:

the protective members are adapted to have different colors or sets of colors for easily changing a color of the head protector based on the color of the protective members; and the protective members are configured to include accessories to change the style of the head protector.

8. The head protector of claim 1 wherein when worn, the gaps between the flexed state protective members are configured to expose top portions of the wearer's head to the environment for ventilating the wearer's head.

9. The head protector of claim 1 wherein: each of the first and second connectors includes a plurality of ribbings extending perpendicularly from a peripheral region of the base connector members, wherein the ribbings extend directly and integrally from each of the base connector members.

10. A head protector wearable by infants and small children, comprising:

first and second connectors, the first connector comprises a first connector post having a first end and a second end, the first end of the first connector post connected to a first connector base and the second end of the first connector post connected to a first connector head, wherein the first connector base and the first connector head are larger than the first connector post, and the second connector comprises a second connector post having a first end and a second end, the first end of the second connector post connected to a second connector base and a second end of the second connector post connected to a second connector head, wherein the second connector base and second connector head are larger than the second connector post;

a plurality of elongated bendable protective members having first and second ends, the protective members comprising a protective material that is flexible, resilient and shock absorbent, wherein the protective members are straight or relatively straight protective members when in a relaxed state and are curved when in a bent or flexed state and are configured to provide protection to a wearer's head from injury resulting from falls when the head protector is worn;

wherein the protective members are distinct members that are spaced away from each other to create gaps between each of the protective members when the head protector is worn;

a first elastic band loop disposed at the first end of each protective member and a second elastic band loop disposed at the second end of each protective member, wherein the first and second elastic band loops are releasably engaged to the coupling members of the first and second connectors;

wherein, when assembled to form the head protector, the protective members remain distinct members in which the first elastic band loops of the protective members are commonly looped around the first connector post between the first connector head and first connector base, and the second elastic band loops of the protective members are commonly looped around the second connector post between the second connector head and second connector base; and wherein when the head protector is unworn by the wearer, the protective members are in their relaxed state, and when the head protector is worn, the protective members are in their flexed state to conform to a wearer's head.

11. The head protector of claim 10 wherein the first and second connector comprise ribbings protruding perpendicularly from an inner surface of the first and second connectors for restricting radial movements of the first and second elastic band loops of the protective members when assembled to form.

12. The head protector of claim 11 wherein the first and second connectors each comprises a single structure formed of a rubber material.

13. The head protector of claim 10 comprising a sun visor having the first and second elastic bands located at opposite ends of the sun visor, wherein the sun visor is releasably engaged to the coupling members of the first and second connectors by means of the first and second elastic bands.

14. The head protector of claim 13 wherein the sun visor includes ethylene-vinyl acetate foam material.

15. The head protector of claim 10 wherein the protective material of the protective members includes solidified polymeric foam or an elastomeric material.

16. The head protector of claim 10 wherein the protective material of the protective members includes solidified polymeric foam.

17. A head protector comprising:

first and second connectors, the first connector comprises a first connector post having a first end and a second end, the first end of the first connector post is connected directly and integrally to a first connector base and the second end of the first connector post is connected to a first connector head, wherein the first connector base and the first connector head are larger than the first connector post, and the second connector comprises a second connector post having a first end and a second end, the first end of the second connector post is connected directly and integrally to a second connector base and a second end of the second connector post is connected to a second connector head, wherein the second connector base and second connector head are larger than the second connector post;

a plurality of elongated protective members having first and second ends, the protective members comprising a protective material that is flexible, resilient and shock absorbent, wherein the protective members are straight or relatively straight protective members when in a relaxed state and are curved when in a bent or flexed state and are configured to provide protection to a wearer's head;

wherein the protective members are distinct members that are spaced away from each other to create gaps between each of the protective members when the head protector is worn; and a first elastic loop is attached to the first end of each protective member and a second elastic loop is attached to the second end of each protective member, wherein the first and second elastic loops are releasably engaged to the first and second connector posts;

wherein, when assembled to form the head protector, the protective members remain distinct members in which the first elastic loop of each of the protective members are commonly looped around the first connector post between the first connector head and first connector base, and the second elastic loop of each of the protective members are commonly looped around the second connector post between the second connector head and second connector base; and wherein when the head protector is unworn by the wearer, the protective members are in their relaxed state, and when the head protector is worn, the protective members are in their flexed state to conform to a wearer's head.

18. The head protector of claim 17, wherein the first and second connectors each comprises a single structure formed of a rubber material; and the first and second connectors each comprises ribbings protruding perpendicular from an inner surface of the first and second connectors for restricting radial movements of the first and second elastic loops of the protective members when assembled to form the head protector.

* * * * *